US005121810A

United States Patent [19]

Araki

[11] Patent Number: 5,121,810

[45] Date of Patent: Jun. 16, 1992

[54] MUFFLER COVER

[75] Inventor: Tsuneo Araki, Tokyo, Japan

[73] Assignee: Kioritz Corporation, Tokyo, Japan

[21] Appl. No.: 629,766

[22] Filed: Dec. 18, 1990

[30] Foreign Application Priority Data

Dec. 19, 1989 [JP] Japan ..... 1-328855

[51] Int. Cl.[5] ..... A47B 81/06

[52] U.S. Cl. ..... 181/198; 181/243; 181/282

[58] Field of Search ..... 181/282, 283, 198, 200, 181/201, 202, 203, 204, 241, 243

[56] References Cited

U.S. PATENT DOCUMENTS 4,422,523 12/1983 Kuwano ..... 181/243 X 4,832,151 5/1989 Araki ..... 181/230 X

*Primary Examiner*—L. T. Hix

*Assistant Examiner*—Khanh Dang

*Attorney, Agent, or Firm*—Browdy and Neimark

[57] ABSTRACT

A muffler cover formed in such a manner that joint sections having a relatively small width are located between a front portion and a top portion, between the front portion and a left side portion, and between the front portion and a right side portion, and that extension sections having substantially the same width as the joint sections are located on both sides of the top portion, the joint sections and the extension sections being folded at an angle of substantially 45 degrees.

1 Claim, 3 Drawing Sheets

MUFFLER COVER

BACKGROUND OF THE INVENTION

The present invention relates to a muffler cover.

Conventionally, a muffler cover has been manufactured by deep drawing of a sheet steel material. Therefore, there has been induced a problem that the manufacturing cost is increased since a die for the deep drawing is necessary, and a problem that the appearance of the muffler cover is degraded because wrinkles tend to be formed on the surface of the product and the muffler cover is not accurately shaped at the time of the deep drawing.

SUMMARY OF THE INVENTION

The present invention is intended to solve these problems of the conventional technique and provide a muffler cover whose structure is simplified and convenient.

That is to say, the muffler cover according to the present invention is formed of a blank which is cut out from a sheet material by press working so that the blank is integrally shaped, the blank comprising: a front portion; a top portion; a left side portion; a right side portion; joint sections having a relatively small width located between the front portion and the top portion, between the front portion and the left side portion, and between the front portion and the right side portion; extension sections which have substantially the same width as the joint sections and are located on both sides of the top portion; other extension sections which have substantially the same width as the joint sections and are located on the upper end of the left side portion and on that of the right side portion; and triangular extension sections located on both ends of the joint section between the front portion and the top portion, the joint sections and the extension sections being folded at an angle of substantially 45 degrees.

Consequently, it is not necessary to use an expensive die for deep drawing, and a blank of the muffler cover can be manufactured by press working in a simple manner and at a lower cost. Louvers, fixing holes, indication cutouts and the like can be previously bored through the muffler cover at the same time of the press working for cutting out the muffler cover from the sheet material. Since the joint sections and the extension sections are folded only at the angle of 45 degrees, wrinkles will not be formed on the surface of the product. Besides, the muffler cover can be made of a plated steel sheet because no drawing is required.

DETAILED DESCRIPTION OF THE PREFERRED EMBODIMENTS

Embodiments of the present invention will be described hereinafter with reference to the attached drawings.

Figure 1:
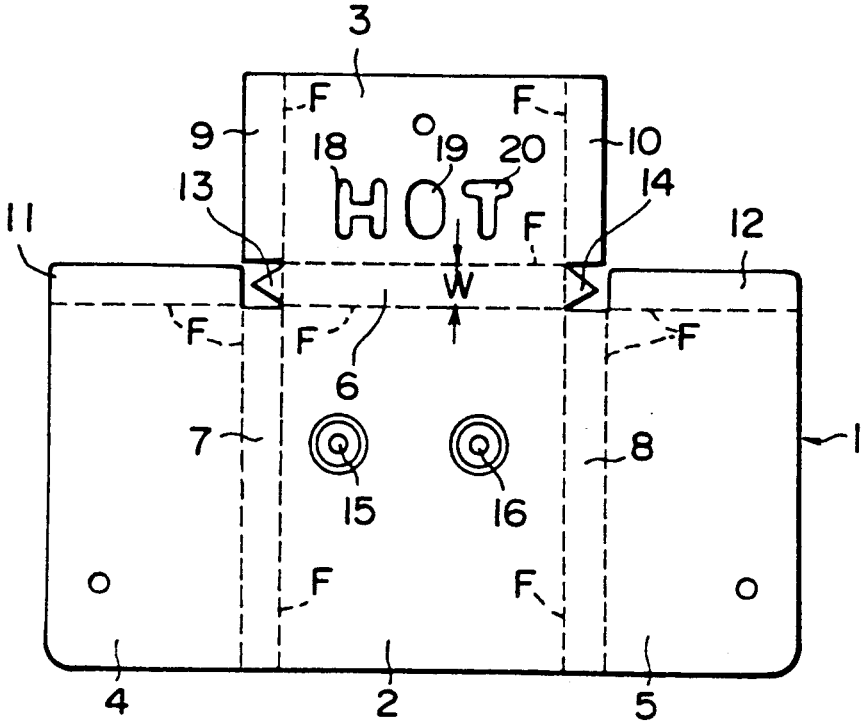
FIG. 1 is a development of a blank showing one embodiment of a muffler cover according to the present invention with louvers and a cut-out section being omitted for clarifying the understanding of the drawing.
Figure 2:
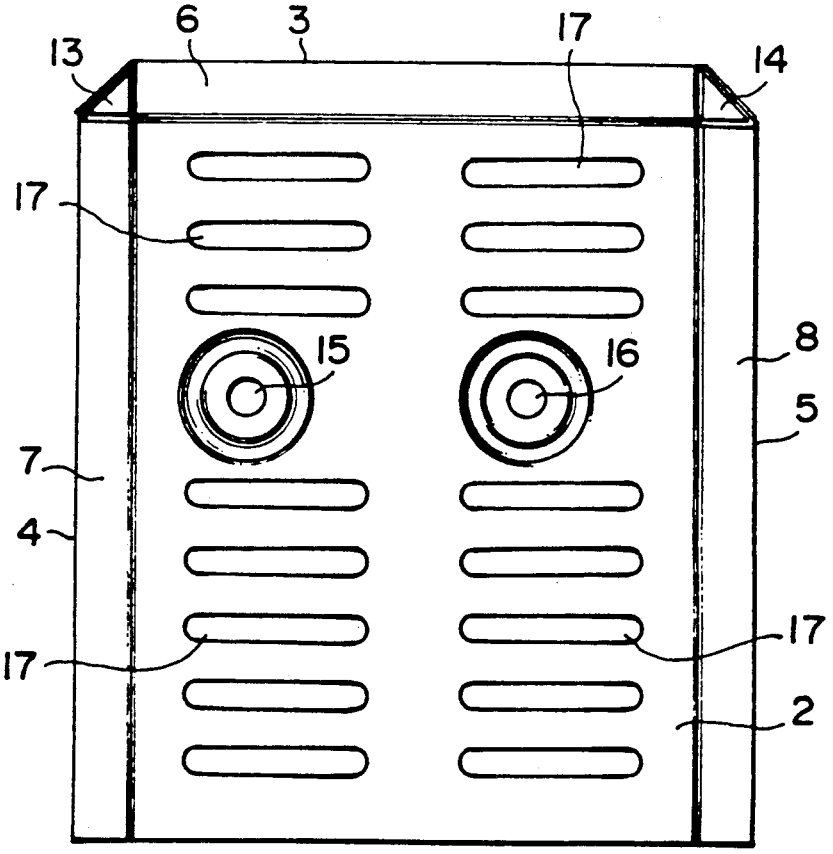
FIG. 2 is a front view of the muffler cover made of the blank shown in FIG. 1.
Figure 3:
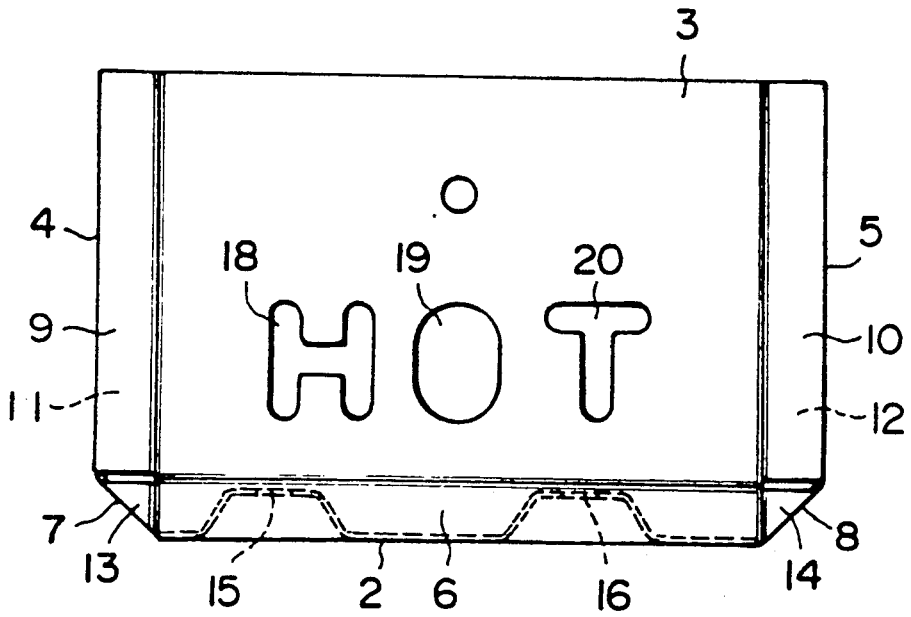
FIG. 3 is a top view of the muffler cover of FIG. 2.
Figure 4:
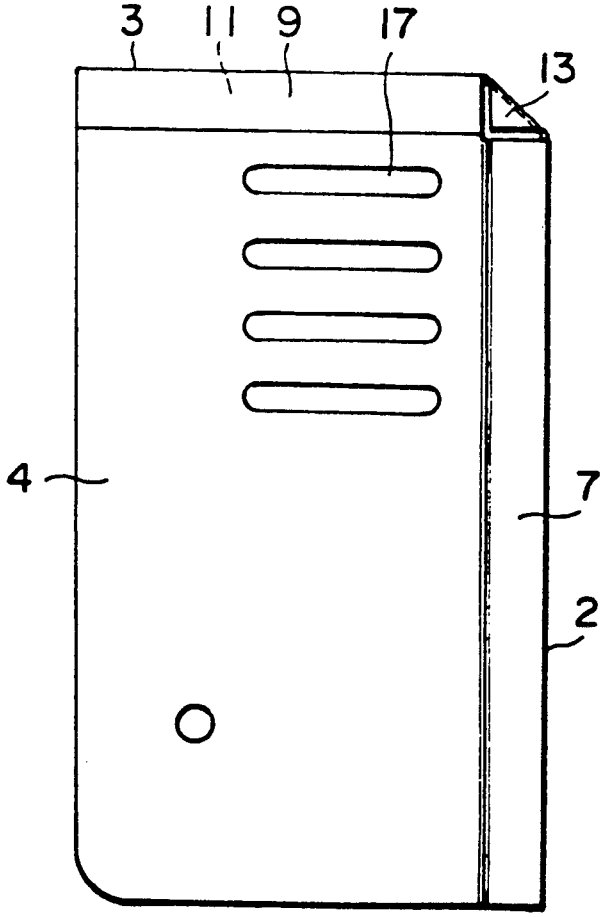
FIG. 4 is a left side view of the muffler cover of FIG. 2.
Figure 5:
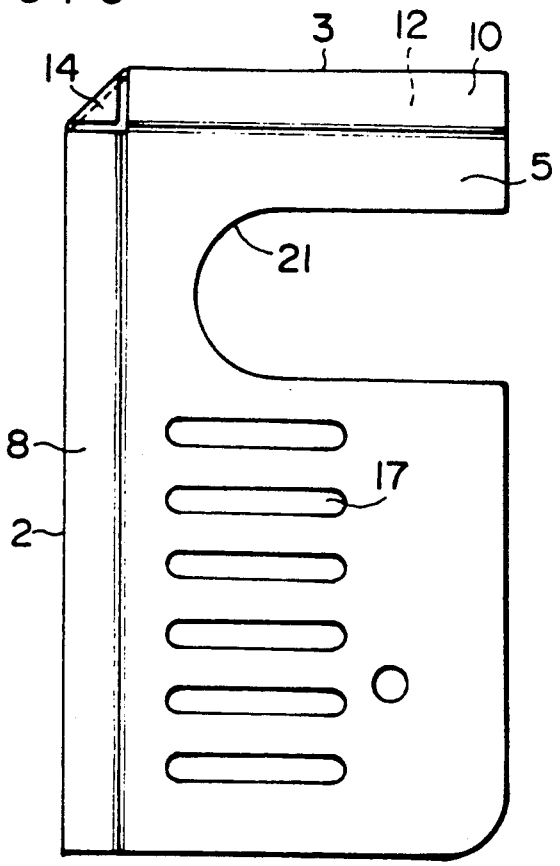
FIG. 5 is a right side view of the muffler cover of FIG. 2.

As shown in FIG. 1, a muffler cover according to one embodiment of the invention is formed of a blank 1 which is cut out of a sheet steel material having a thickness of about 1 mm by press working. The blank 1 is constituted of rectangular portions, i.e., a front portion 2, a top portion 3, a left side portion 4 and a right side portion 5. The front portion 2 and the top portion 3 are integrally connected by a joint section 6 extending over the entire length of the boundary ends thereof, and similarly, the front portion 2 is integrally connected with the left side portion 4 and the right side portion 5 by joint sections 7 and 8, respectively. The joint sections 6, 7 and 8 are all shaped to have a relatively small width W. Extension sections 9 and 10 are integrally formed on both the left and right ends of the top portion 3, respectively, and other extension sections 11 and 12 are also integrally formed on the respective upper ends of the left and right side portions 4 and 5. Further, triangular extension sections 13 and 14 in the shape of an equilateral triangle are respectively integrally formed on both the left and right ends of the joint section 6 between the front portion 2 and the top portion 3.

The blank 1 thus shaped is folded in an identical direction along folding lines F indicated with dashed lines in FIG. 1, and is formed into a box-like shape shown in FIGS. 2 to 5. In this case, the joint sections 6, 7 and 8 and the extension sections 9, 10, 11, 12, 13 and 14 are each inclined to its adjacent planes of the portions 2, 3, 4 and 5 at an angle of 45 degrees. As a result, the upper and lower ends of the triangular extension section 13 on the left side are respectively in contact with the adjacent upper end of the left joint section 7 and the adjacent front end of the left extension section 9 of the top portion 3, while the upper and lower ends of the triangular extension section 14 on the right side are respectively in contact with the adjacent upper end of the right joint section 8 and the adjacent front end of the right extension section 10 of the top portion 3. Further, the left and right extension sections 9 and 10 of the top portion 3 are superposed on the extension sections 11 and 12 on the upper ends of the left and right side portions 4 and 5, respectively, and such superposed sections are joined by spot welding or the like. In this manner, the front portion 2, the top portion 3, the left side portion 4 and the right side portion 5 constitute the muffler cover formed in a rectangular parallelepiped box-like shape as a whole. The appearance of the muffler cover thus constituted is illustrated in a front view of FIG. 2, a top view of FIG. 3, a left side view of FIG. 4, and a right side view of FIG. 5.

At the same time of the press working prior to the above-described folding operation of the blank 1, the front portion 2 of the blank 1 is formed with holes 15 and 16 for fixing bolts with which the muffler cover is fixed on the main body of a muffler and a plurality of louvers 17 for ventilation by press working, and the left side portion 4 and the right side portion 5 are also formed with louvers 17 of the same kind by press working. In addition, the top portion 3 is formed with indication cutouts 18, 19 and 20 in the shape of a word "HOT" by press working, and these indication cutouts 18, 19 and 20 instruct the users that the muffler cover is dangerous for its high temperature, and also serve as ventilation holes. Besides, a section 21 through which an exhaust pipe passes is cut out of the right side portion 5 by press working.

Figure 6:
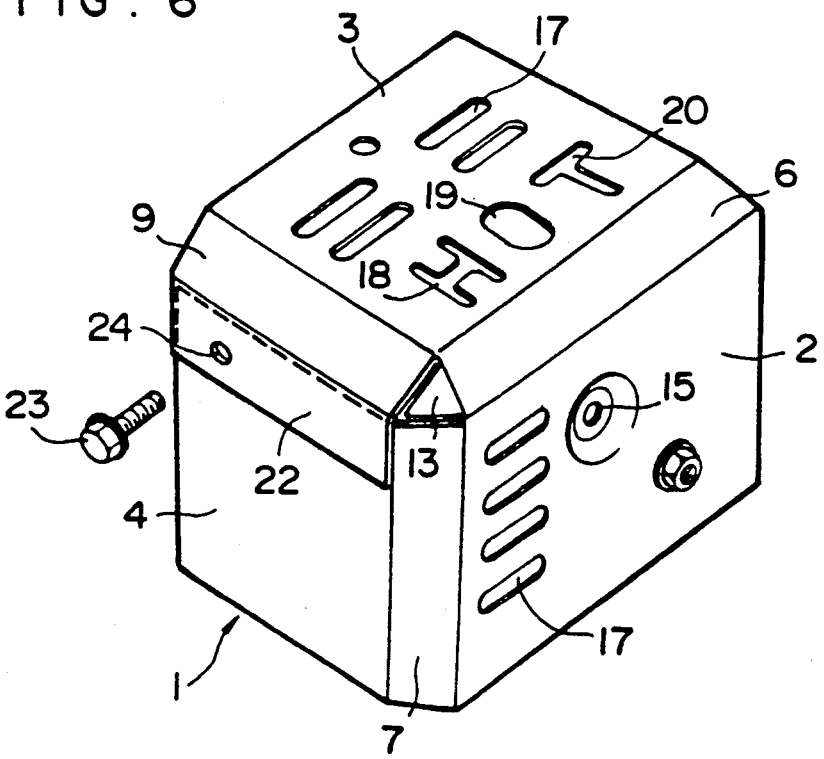
FIG. 6 is a perspective view showing another embodiment of a muffler cover according to the present invention.

Another embodiment of the present invention is shown in FIG. 6. In this embodiment, the left extension section 9 of the top portion 3 of the blank 1, for example, is integrally formed with an overhanging section 22 continuously extending therefrom. When the blank 1 is folded in the above-described manner, as shown in FIG. 6, the overhanging section 22 is superposed on the left side portion 4. In this case, a screw fastener 23 is tightly fitted into a screw hole 24 of the left side portion 4 through the overhanging section 22 so that the overhanging section 22 can be fastened on the left side portion 4, and that the muffler cover can be fixed on the main body of the muffler. Similarly, the right extension section 10 of the top portion 3 is formed with an overhanging section of the same kind (not shown), and this overhanging section is also screwed on the right side portion 5. Thus, portions of the blank of the muffler cover can be joined with each other by screw-fastening instead of spot welding.

What is claimed is:

1. A muffler cover formed of a blank which is cut out from a sheet material by press working so that said blank is integrally shaped, said muffler cover comprising: a front portion; a top portion; a left side portion; a right side portion; joint sections having a relatively small width located between said front portion and said top portion, between said front portion and said left side portion, and between said front portion and said right side portion; extension sections which have substantially the same width as said joint sections and are extended from left and right sides of said top portion; other extension sections which have substantially the same width as said joint sections and are extended from upper ends of said left and right side portions; and triangular extension sections extended from left and right side ends of said joint section between said front portion and said top portion, said joint sections and said extension sections being folded at an angle of substantially 45 degrees.

* * * * *